US006652242B2

(12) United States Patent
Wu

(10) Patent No.: US 6,652,242 B2
(45) Date of Patent: Nov. 25, 2003

(54) PUMP

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 0 days.

(21) Appl. No.: 10/099,091

(22) Filed: Mar. 15, 2002

(65) Prior Publication Data

US 2003/0026706 A1 Feb. 6, 2003

(30) Foreign Application Priority Data

Jul. 31, 2001 (TW) ..... 90213075 U

(51) Int. Cl.[7] ..... F04B 11/00; F04B 33/00
(52) U.S. Cl. ..... 417/63; 417/544; 417/555.1
(58) Field of Search ..... 417/63, 540, 544, 417/555.1, 556, 559

(56) References Cited

U.S. PATENT DOCUMENTS 409,163 A * 8/1889 Boekel ..... 417/555.1
1,425,614 A * 8/1922 Stickel ..... 417/63
1,530,703 A * 3/1925 Snodgrass ..... 417/544
1,539,556 A * 5/1925 Garber ..... 417/544
1,705,401 A * 3/1929 Grimley ..... 417/544
1,776,147 A * 9/1930 Clagett ..... 417/555.1
2,348,190 A * 5/1944 Bullock ..... 417/544
3,907,461 A * 9/1975 Bouder ..... 417/63
5,964,577 A * 10/1999 Chuang ..... 417/63
6,325,601 B2 * 12/2001 Wu ..... 417/559

* cited by examiner

*Primary Examiner*—Michael Koczo
(74) *Attorney, Agent, or Firm*—Alan D. Kamrath; Rider Bennett, LLP

(57) ABSTRACT

In the present invention, a pump includes a cylinder, a plunger for compressing air in the cylinder, a reservoir formed around the cylinder so as to define a space for storing a portion of the compressed air, a valve device installed in the cylinder for permission of the compressed air from the cylinder into the reservoir and a base connected with the cylinder for stabilizing the pump. The base includes two pedals extending in opposite directions from the cylinder.

14 Claims, 5 Drawing Sheets

PUMP

BACKGROUND OF INVENTION

1. Field of Invention

The present invention is related to a pump.

2. Related Prior Art

Various pumps have been devised to pump air into various articles such as tires and balls. For example, Taiwanese Patent Publication No. 200910 teaches a conventional pump as shown in Fig. 6. This conventional pump includes a cylinder, a plunger for cooperating with the cylinder to produce compressed air, a reservoir for storing the compressed air and a pedal for stablizing the pump in operation. The reservoir is installed on one side of the cylinder, and the pedal is mounted on an opposite side of the cylinder. In operation, a user sets one foot on the pedal, and operates the plunger with his or her hands. Since only one side of the pump is subject to a portion of the user's weight, the pump tends to swing in operation, thus reducing the efficiency of pumping.

The present invention is therefore intended to obviate or at least alleviate the problems encountered in prior art.

SUMMARY OF INVENTION

It is an objective of the present invention to provide a pump.

In the present invention, a pump includes a cylinder, a plunger for compressing air in the cylinder, a reservoir formed around the cylinder so as to define a space for storing a portion of the compressed air, a valve device installed in the cylinder for transfer of the compressed air from the cylinder into the reservoir and a base connected with the cylinder for stabilizing the pump. The base includes two pedals extending in opposite directions from the cylinder.

The cylinder includes an upper chamber in which the plunger is inserted, a lower chamber in which the valve device is installed and a hole communicating the upper chamber with the lower chamber, and the lower chamber is in communication with the space.

The cylinder includes two annular portions formed on opposite sides of the lower chamber for sealing the space. Two rings are mounted on the annular portions of the cylinder for sealing the space.

The valve device includes a shell, a check valve and two rings. The shell includes a chamber defined therein, an inlet in communication with the chamber and an outlet in communication with the chamber. The check valve is installed in the chamber for transfer of the compressed air from the inlet to the outlet. The rings are mounted on the shell on two opposite sides of the inlet for defining an annular space as communication between the hole and the inlet.

The reservoir includes a channel in communication with the space. The channel includes an enlarged terminal portion for receiving a pressure meter.

BRIEF DESCRIPTION OF DRAWINGS

The present invention is described through detailed illustration of embodiments referring to the attached drawings wherein.

DETAILED DESCRIPTION OF PREFERRED EMBODIMENTS

Figure 1:
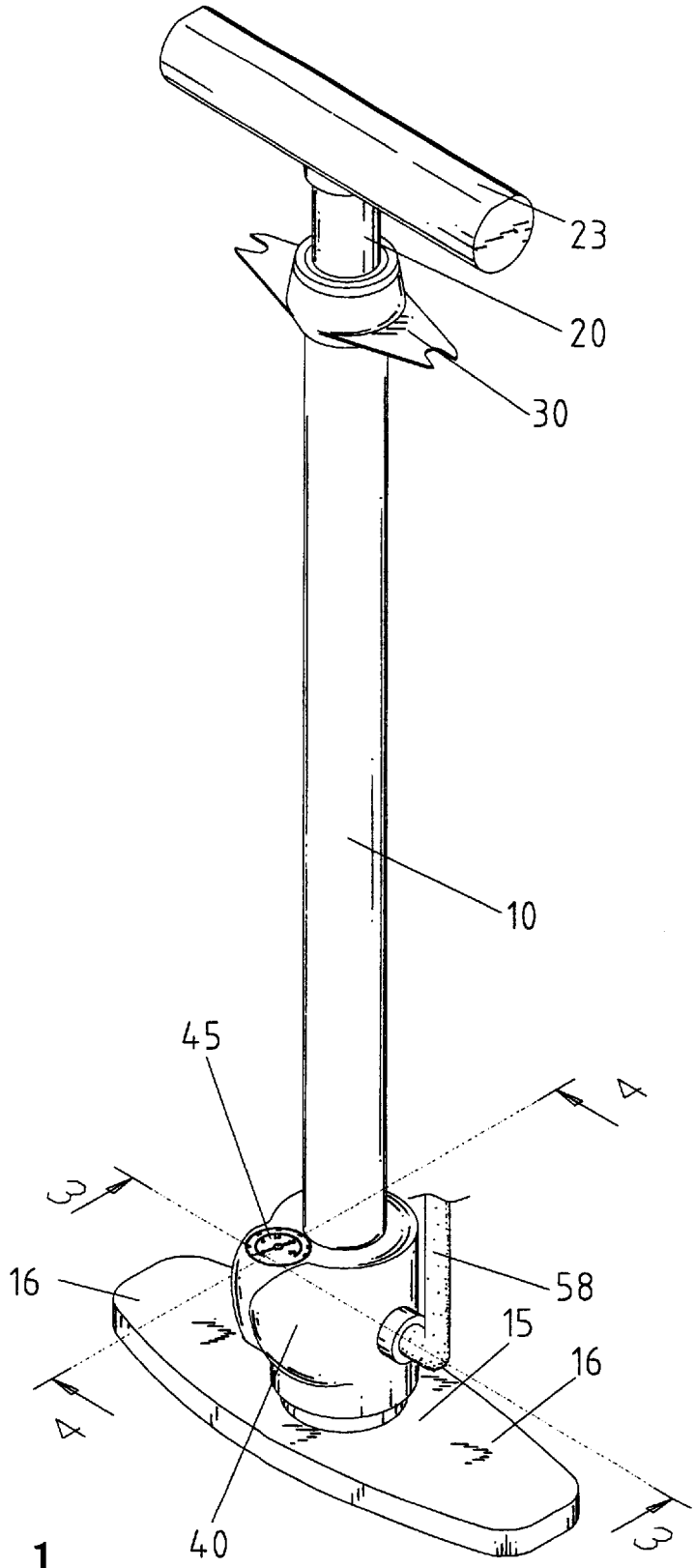
FIG. 1 is a perspective view of a pump of the present invention.

FIGS. 1–5 show a pump according to the present invention. The pump includes a cylinder 10, a plunger 20 for compressing air in the cylinder 10, a reservoir 40 for storing the compressed air, a valve device 50 for transfer of the compressed air from the cylinder 10 into the reservoir 40 and not vice versa and a base 15 for stabilizing the pump.

Figure 2:
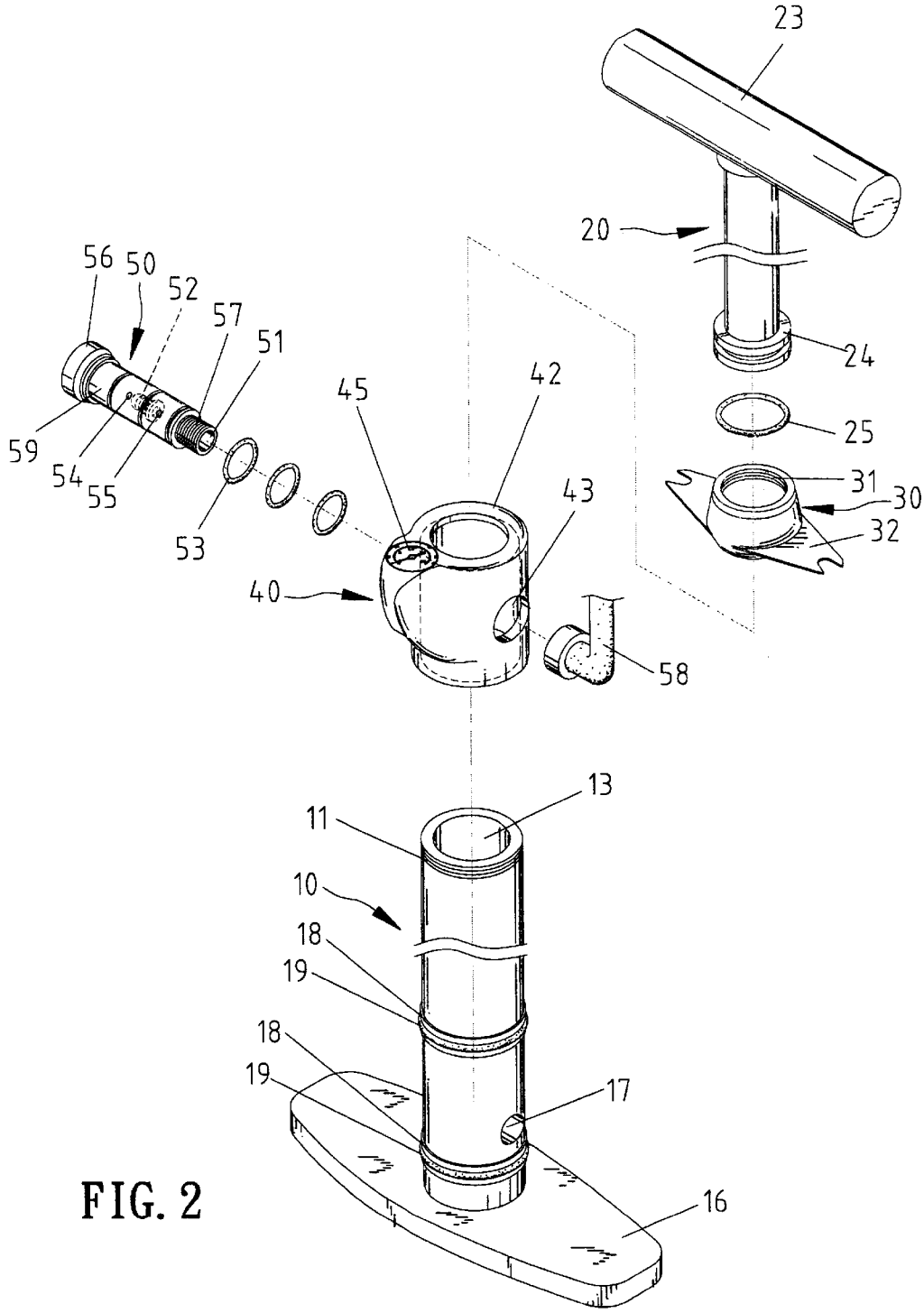
FIG. 2 is an exploded view of the pump of FIG. 1.

Referring to FIG. 2, the cylinder 10 is integrated with the base 15 at a lower end thereof. The base 15 includes two pedals 16 extending in opposite directions from the lower end of the cylinder 10. A user can set his or her feet on the pedals 16 while using the pump, thus retaining the pump in a balanced position.

Referring to FIGS. 2 to 5, the cylinder 10 includes an upper chamber 13, a hole 14 and a lower chamber 17 in communication with the upper chamber 13 through the hole 14. The cylinder 10 includes two annular portions 18 formed thereon so that the lower chamber 17 is positioned between the annular portions 18. A ring 19 is received in an annular groove defined in each of the annular portions 18.

Figure 4:
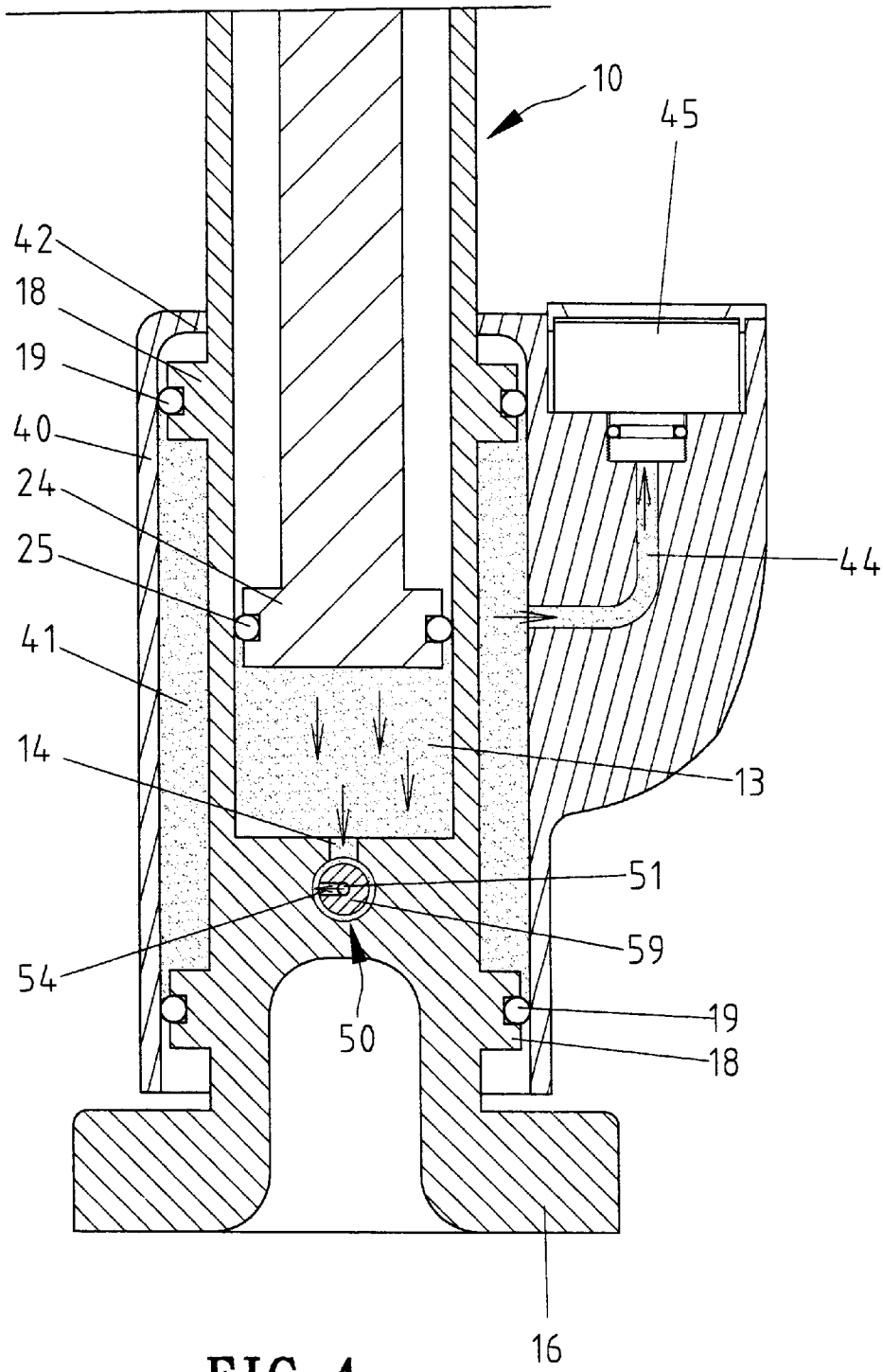
FIG. 4 is a cross-sectional view taken along a line 4—4 in FIG. 1.

The reservoir 40 is a cylindrical element. An annular portion 42 is formed at an upper end of the reservoir 40. The annular portion 42 includes an internal diameter smaller than that of the reservoir 40. Two holes 43 are defined in the reservoir 40. Referring to FIG. 4, a channel 44 is defined in a block formed on the reservoir 40. The channel 44 is in communication with the space defined in the reservoir 40. A pressure meter 45 is installed in an enlarged portion of the channel 44.

Figure 3:
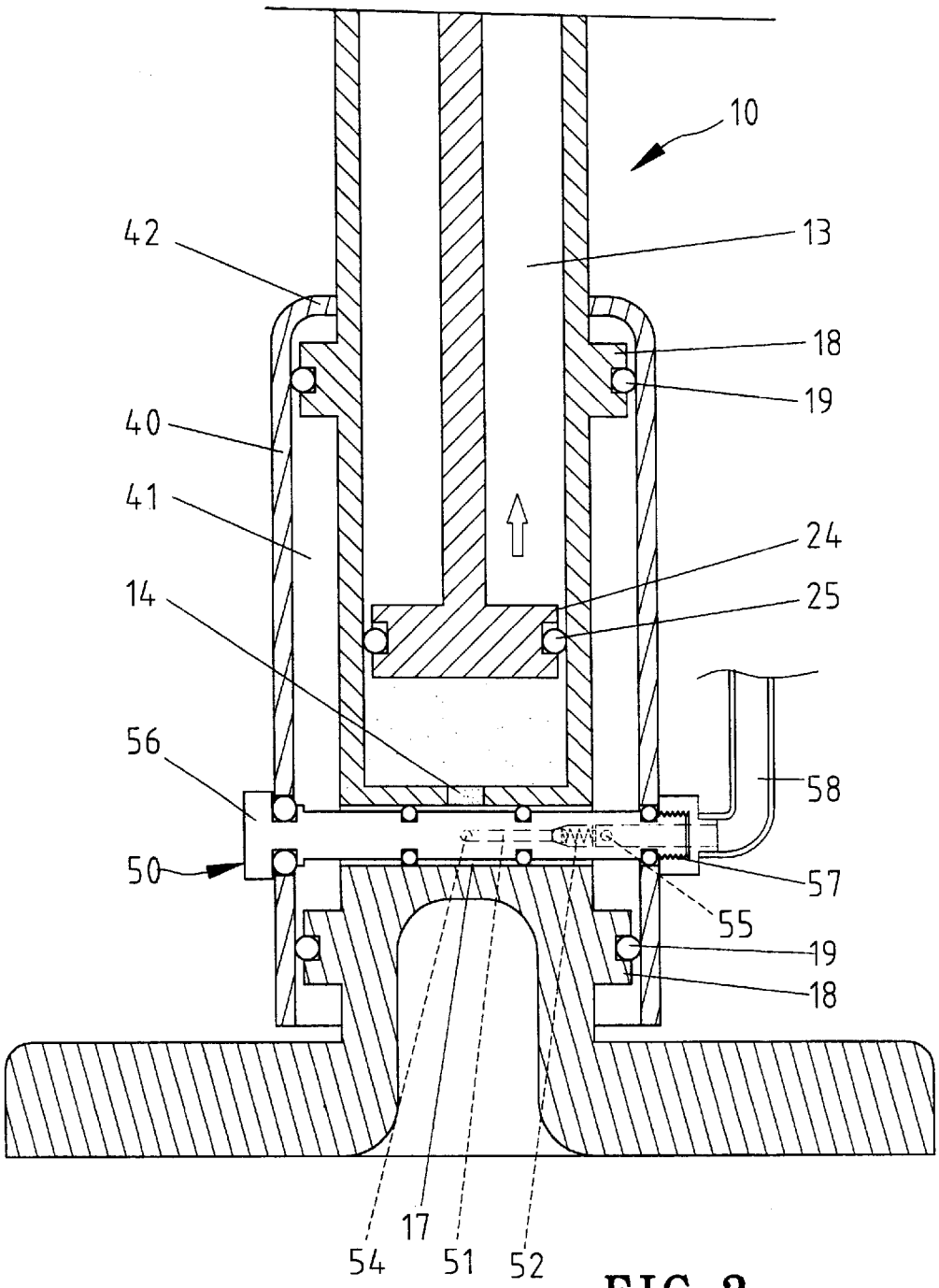
FIG. 3 is a cross-sectional view taken along a line 3—3 in FIG. 1.
Figure 5:
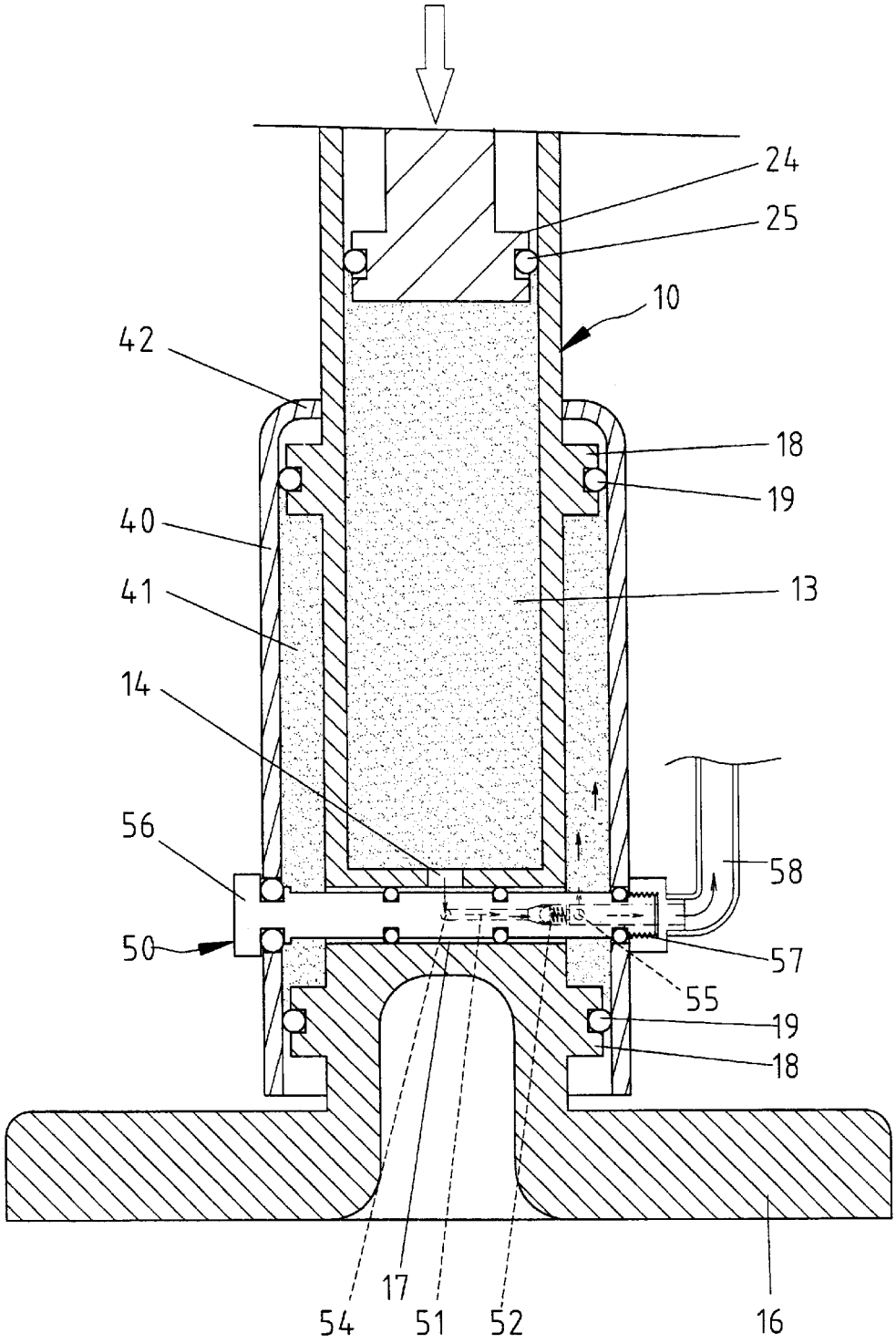
FIG. 5 is a view similar to FIG. 3 but showing a piston in a different position.

Referring to FIGS. 3 to 5, the reservoir 40 is mounted on the cylinder 10 so that a space 41 is defined by means of the cylinder 10, the reservoir 40 and the annular portions 18 on which the rings 19 are mounted. The rings 19 are used to avoid leakage of air from the space 41. Thus, the space 41 becomes airtight and can be used to store compressed air.

The valve device 50 includes a shell 59 that defines a chamber 51, an inlet 54 and an outlet 55. The chamber 51 is in communication with the inlet 54 and with the outlet 55. A check valve 52 is installed in the chamber 51 so as to allow air to flow from the inlet 54 to the outlet 55. Three rings 53 are respectively received in three annular grooves defined in an external surface of the shell 59. The shell 59 includes a plug 56 formed at an end thereof and a thread 57 formed at an opposite end thereof.

Referring to FIGS. 3 through 5, the valve device 50 is inserted into the lower chamber 17 through one of the holes 43 until this hole 43 is closed by means of the plug 56. The thread 57 is exposed to the exterior of the reservoir 40 through the remaining one of the holes 43. The hole 14 is positioned between two of rings 53 between which the inlet 54 is located. Thus, the hole 14 is in communication with the inlet 54. The outlet 55 is in communication with the space 41. The remaining one of the holes 43 is sealed by means of the remaining one of the rings 53. The thread 57 is engaged with a thread formed on an internal surface of a joint 58. The joint 58 is secured to an end of a pipe that leads to an article to be inflated.

Referring to FIG. 2, the plunger 20 includes a piston 24 formed at a lower end thereof. A ring 25 is received in an annular groove defined in the piston 24. The plunger 20 is inserted in the upper chamber 13. A fastener 30 includes a thread 31 formed on an internal surface thereof and two holders 32 formed on and external surface thereof. The fastener 30 is mounted on the plunger 20 before a handle 23 is connected with an upper end of the plunger 20. The thread 31 is engaged with a thread 11 formed at an upper end of the cylinder 10, thus keeping the piston 24 in the cylinder 10.

Operation of the pump of the present invention will be described referring to FIGS. 3 to 5. When the piston 24, on which the ring 25 is mounted, is moved down from a position shown in FIG. 5 to a position shown in FIG. 3, air is compressed in the upper chamber 13. The compressed air flows from the upper chamber 13 into the lower chamber 17 through the hole 14. Then, the compressed air flows from the lower chamber 17 into the chamber 51 through the inlet 54. The compressed air presses open the check valve 52 so as to flow from a first section of the chamber 51 to a second section of the chamber 51. A large portion of the compressed air flows from the second section of the chamber 51 to a pipe through the joint 58. The pipe leads to and article to be inflated, such as a tire. A small portion of the compressed air flows from the second section of the chamber 51 into the space 41 through the outlet 55. The article subject to inflation is in communication with the space 41 through the pipe, the joint 58, the second section of the chamber 51 and the outlet 55. The space 41 is in communication with the channel 44 leading to the pressure meter 45. Thus, the air pressure in the article subject to inflation is identical to that in the channel 44. Therefore, the air pressure in the article subject to inflation can be observed by checking the pressure mete 45 in communication with the channel 44.

The preferred embodiment of the present invention has been described for the purposes of illustration. Those skilled in the art can derive a lot of variations from these embodiments after a study of this patent specification. Therefore, these embodiments shall by no means limit the scope of the present invention. The scope of the present invention can only be defined in the claims attached to and taken as a portion of this patent specification.

What is claimed is:

1. A pump including a cylinder, a plunger for compressing air in the cylinder, a reservoir formed on the cylinder so as to define a space for storing a portion of the compressed air, and a valve device installed in the cylinder for transfer of the compressed air from the cylinder into the reservoir, wherein the cylinder includes an upper chamber in which the plunger is inserted, a lower chamber in which the valve device is installed and a hole communicating the upper chamber with the lower chamber, and the lower chamber is in communication with the space, wherein the reservoir is formed around the cylinder, and wherein the cylinder includes two annular portions formed on opposite sides of the lower chamber for sealing the space.

2. The pump according to claim 1 further including a base connected with the cylinder for stabilizing the pump, wherein the base includes two pedals extending in opposite directions from the cylinder.

3. The pump according to claim 1 including two rings each mounted on one of the annular portions of the cylinder for sealing the space.

4. The pump according to claim 1 including a pressure meter installed on the reservoir.

5. The pump according to claim 3 wherein the valve device includes:

a shell including a chamber defined therein, an inlet in communication with the chamber and an outlet in communication with the chamber;

a check valve installed in the chamber for permission of the compressed air from the inlet to the outlet; and two rings mounted on the shell on two opposite sides of the inlet for defining an annular space as communication between the hole and the inlet.

6. A pump including a cylinder, a plunger for compressing air in the cylinder, a reservoir formed on the cylinder so as to define a space for storing a portion of the compressed air, and a valve device installed in the cylinder for transfer of the compressed air from the cylinder into the reservoir, wherein the cylinder includes an upper chamber in which the plunger is inserted, a lower chamber in which the valve device is installed and a hole communicating the upper chamber with the lower chamber, and the lower chamber is in communication with the space, wherein the valve device includes:

a shell including a chamber defined therein, an inlet in communication with the chamber and an outlet in communication with the chamber;

a check valve installed in the chamber for transfer of the compressed air from the inlet to the outlet; and two rings mounted on the shell on two opposite sides of the inlet for defining an annular space as communication between the hole and the inlet.

7. A pump including a cylinder, a plunger for compressing air in the cylinder, a reservoir formed on the cylinder so as to define a space for storing a portion of the compressed air, a valve device installed in the cylinder for permission of the compressed air from the cylinder into the reservoir, and a pressure meter installed on the reservoir, wherein the reservoir includes a channel in communication with the space, and the channel includes an enlarged terminal portion for receiving the pressure meter.

8. The pump according to claim 7 further including a base connected with the cylinder for stabilizing the pump, and wherein the reservoir is formed around the cylinder.

9. The pump according to claim 7 wherein the reservoir is formed around the cylinder, and wherein the cylinder includes two annular portions formed on opposite sides of the lower chamber for sealing the space.

10. The pump according to claim 9 further including two rings each mounted on one of the annular portions of the cylinder for sealing the space.

11. The pump according to claim 7 further including a base connected with the cylinder for stabilizing the pump, wherein the base includes two pedals extending in opposite directions from the cylinder.

12. The pump according to claim 7 wherein the cylinder includes an upper chamber in which the plunger is inserted, a lower chamber in which the valve device is installed and a hole communicating the upper chamber with the lower chamber, and the lower chamber is in communication with the space.

13. The pump according to claim 7 wherein the valve device includes:

a shell including a chamber defined therein, an inlet in communication with the chamber and an outlet in communication with the chamber;

a check valve installed in the chamber for permission of the compressed air from the inlet to the outlet; and two rings mounted on the shell on two opposite sides of the inlet for defining an annular space as communication between the hole and the inlet.

14. A pump including a cylinder, a plunger for compressing air in the cylinder, a reservoir formed on the cylinder so as to define a space for storing a portion of the compressed air, and a valve device installed in the cylinder for transfer of the compressed air from the cylinder into the reservoir, and a base connected with the cylinder for stabilizing the pump, and wherein the reservoir is formed around the cylinder, wherein the cylinder includes an upper chamber in which the plunger is inserted, a lower chamber in which the valve device is installed and a hole communicating the upper chamber with the lower chamber, and the lower chamber is in communication with the space.

* * * * *